US011045010B2

(12) United States Patent
Anderson

(10) Patent No.: US 11,045,010 B2
(45) Date of Patent: Jun. 29, 2021

(54) PILLOW COVER AND METHOD OF USE

(71) Applicant: Rhea N. Anderson, Parkville, MO (US)

(72) Inventor: Rhea N. Anderson, Parkville, MO (US)

( * ) Notice: Subject to any disclaimer, the term of this patent is extended or adjusted under 35 U.S.C. 154(b) by 0 days.

(21) Appl. No.: 16/789,983

(22) Filed: Feb. 13, 2020

(65) Prior Publication Data

US 2020/0253386 A1 Aug. 13, 2020

Related U.S. Application Data

(63) Continuation-in-part of application No. 29/695,610, filed on Jun. 20, 2019.

(60) Provisional application No. 62/804,894, filed on Feb. 13, 2019.

(51) Int. Cl.

| | |
|---|---|
| ***A47C 21/02*** | (2006.01) |
| ***A47G 9/02*** | (2006.01) |
| ***A47G 9/10*** | (2006.01) |

(52) U.S. Cl.

CPC ..... *A47C 21/026* (2013.01); *A47G 9/0253* (2013.01); *A47G 9/10* (2013.01)

(58) Field of Classification Search

CPC .. A47G 9/0253; A47G 9/0246; A47G 9/0238; A47G 9/0223; A47G 9/02; A47G 9/10; A47G 2009/1018; A47G 9/1081; A47C 7/383; A47C 21/026

USPC ..... 5/490, 485, 482, 497, 636, 639, 640

See application file for complete search history.

(56) References Cited

U.S. PATENT DOCUMENTS

| | | | | | |
|---|---|---|---|---|---|
| 1,343,881 | A * | 6/1920 | Christensen | A47G 9/0284 | 5/485 |
| 1,871,003 | A * | 8/1932 | Longletz et al. | A47C 27/002 | 5/490 |
| 2,462,780 | A * | 2/1949 | Schiller | A47G 9/02 | 5/485 |
| 2,586,031 | A * | 2/1952 | Hahne | A47G 9/02 | 5/485 |
| 3,148,388 | A * | 9/1964 | Espersen | A47G 9/02 | 5/485 |
| 3,638,251 | A * | 2/1972 | Weiss | A47G 9/02 | 5/485 |
| 3,800,340 | A * | 4/1974 | Valentine | A47G 9/02 | 5/485 |
| 4,014,055 | A * | 3/1977 | Torres | A47G 9/0284 | 5/485 |
| 4,924,543 | A * | 5/1990 | Hoss | A47G 9/02 | 5/421 |

(Continued)

*Primary Examiner* — Robert G Santos

(74) *Attorney, Agent, or Firm* — Law Office of Mar Brown, LLC; Christopher M. DeBacker

(57) ABSTRACT

A pillow cover which includes a pocket for receiving a pillow and blanket or sheet material extending away from the pocket to provide a combination pillow and blanket. This provides a comfortable sleeping object which allows for additional covering of the arms and/or body while also providing a sleeping surface for the user's head. The blanket or sheet material may end in a covering flap along one or more of its edges. These covering flaps provide a cavity for receiving a portion of the user's body, such as an arm. These flaps may further be secured on one end with a seam to form a partially closed pocket, or the flaps may be free along their ends.

6 Claims, 6 Drawing Sheets

(56) References Cited

U.S. PATENT DOCUMENTS 5,331,699 A * 7/1994 Patton ..... A47D 13/08 128/876
5,438,719 A * 8/1995 Anthony ..... A47G 9/02 5/485
5,450,640 A * 9/1995 Patton ..... A47D 15/008 5/655
5,991,946 A * 11/1999 Harris ..... A47G 9/0246 5/485
5,996,147 A * 12/1999 Trimble ..... A47G 9/02 5/482
6,049,925 A * 4/2000 Lewis ..... A47G 9/02 5/482
6,539,565 B1 * 4/2003 Trimble ..... A47G 9/02 5/482
7,971,292 B1 * 7/2011 Sithian ..... A47C 20/021 5/485
8,127,378 B1 * 3/2012 Mintz ..... A47G 9/0207 5/485
8,438,679 B2 * 5/2013 Wootten, Jr. ..... A47C 31/105 5/482
8,490,229 B2 * 7/2013 Mintz ..... A47G 9/0246 5/485
8,984,683 B2 * 3/2015 Mintz ..... H05B 3/145 5/485
9,332,853 B2 * 5/2016 Mintz ..... A47G 9/0238
9,924,812 B1 * 3/2018 Kennedy ..... A47G 9/0246
10,856,677 B2 * 12/2020 Wootten, Jr. ..... A47G 9/04
2009/0205134 A1 * 8/2009 Wootten, Jr. ..... A47G 9/0246 5/488
2012/0159710 A1 * 6/2012 Mintz ..... A47G 9/0246 5/505.1
2013/0247297 A1 * 9/2013 Wootten, Jr. ..... A47G 9/04 5/499
2013/0291302 A1 * 11/2013 Mintz ..... A47G 9/0223 5/421
2015/0189995 A1 * 7/2015 Mintz ..... H05B 3/56 5/421
2020/0253386 A1 * 8/2020 Anderson ..... A47C 21/026

* cited by examiner

PILLOW COVER AND METHOD OF USE

CROSS-REFERENCE TO RELATED APPLICATION

This application is a continuation-in-part of U.S. Design patent application No. 29/695,610 filed Jun. 20, 2019, and claims priority in U.S. Provisional Patent Application No. 62/804,894 filed Feb. 13, 2019, both of which are incorporated herein by reference.

BACKGROUND OF THE INVENTION

1. Field of the Invention

The present invention relates generally to a pillow cover and method for use thereof, and more specifically to a pillow cover with extended ends functioning as a covering.

2. Description of the Related Art

Blankets and pillows are common bedding items. However, both items perform a singular function. While there are products which transform a blanket into other objects, including pillows, there is a need for a pillow cover which provides the functionality of sheets and blankets.

Heretofore there has not been available a system or method for a pillow cover with the advantages and features of the present invention.

BRIEF SUMMARY OF THE INVENTION

The present invention generally provides a pillow cover which includes a pocket for receiving a pillow and blanket or sheet material extending away from the pocket to provide a combination pillow and blanket. This provides a comfortable sleeping object which allows for additional covering of the arms and/or body while also providing a sleeping surface for the user's head.

The blanket or sheet material may end in a covering flap along one or more of its edges. These covering flaps provide a cavity for receiving a portion of the user's body, such as an arm. These flaps may further be secured on one end with a seam to form a partially closed pocket, or the flaps may be free along their ends.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Pillow Covering 2

Figure 6:
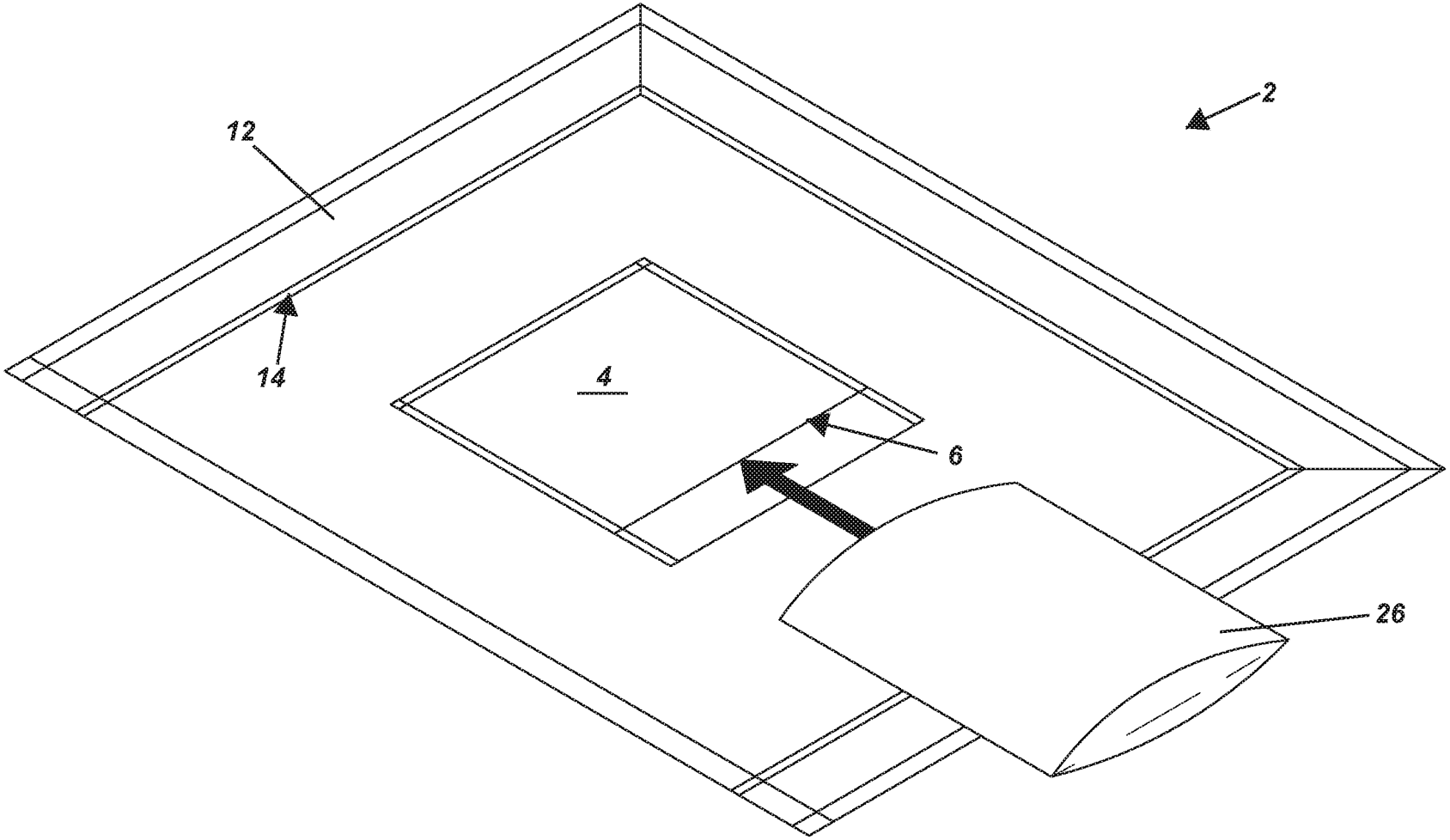
FIG. 6 is a three-dimensional isometric view thereof shown in a typical environment of a pillow being inserted into the embodiment.
Figure 7:
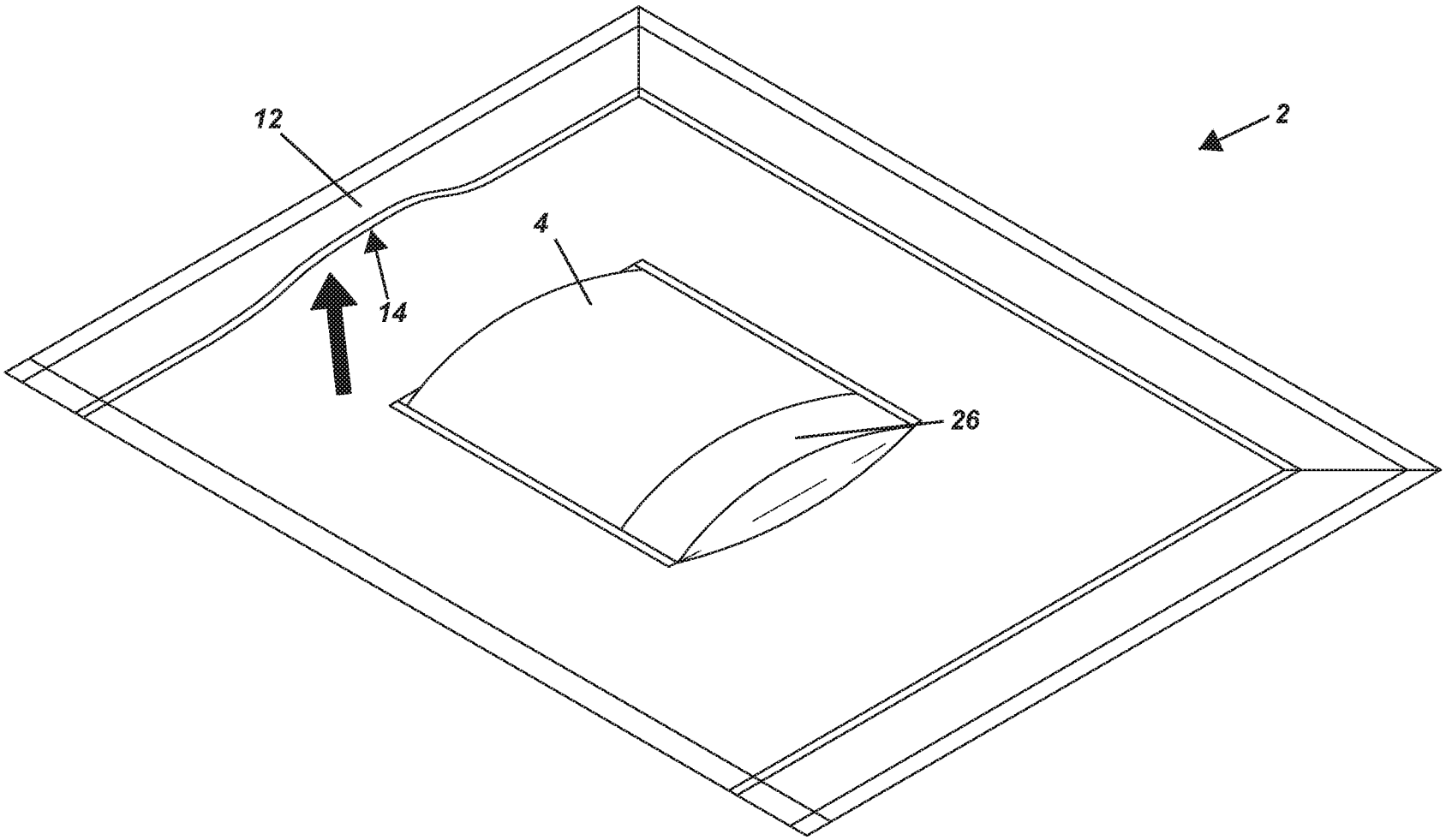
FIG. 7 is a three-dimensional isometric view thereof shown in a typical environment of a pillow inserted into the embodiment and a portion of a sleeve element being lifted.

As shown the figures, the present invention provides a combination pillow covering and blanket device 2. A sleeve 4 forms a pocket 6 within the covering 10 which receives a pillow 26 as shown in FIGS. 6 and 7. A flap 8 may optionally be included to fold over the end of the pillow once inserted into the pocket 6.

The edges of the covering 10 provide a blanket or sheet to be used to cover a portion of the user's body. The covering 10 extends away from the sleeve 4 some distances such that it can be used as a covering, at least six inches on either side. These edges include a covering flap 12 along the side 18 and rear 20 edge of the covering 10. The front edge 22 does not include a covering flap 12 in the preferred embodiment. This covering flap 12 covers a pocket 14 for receiving a portion of a user's body, such as their arm. Thus, this covering flap 12 must be wide enough to cover a user's arm, at least 4 inches wide.

Figure 1:
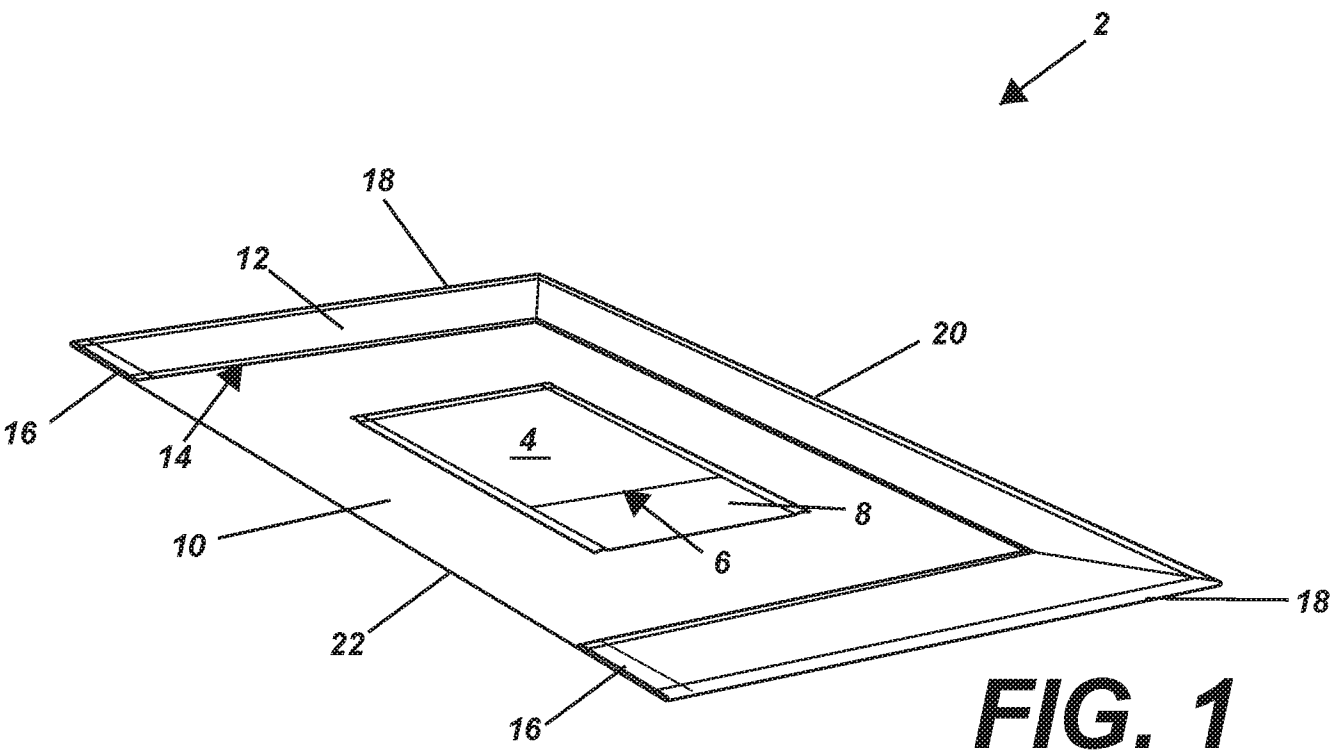
FIG. 1 is a three-dimensional isometric view of a preferred embodiment of the present invention.
Figure 2:
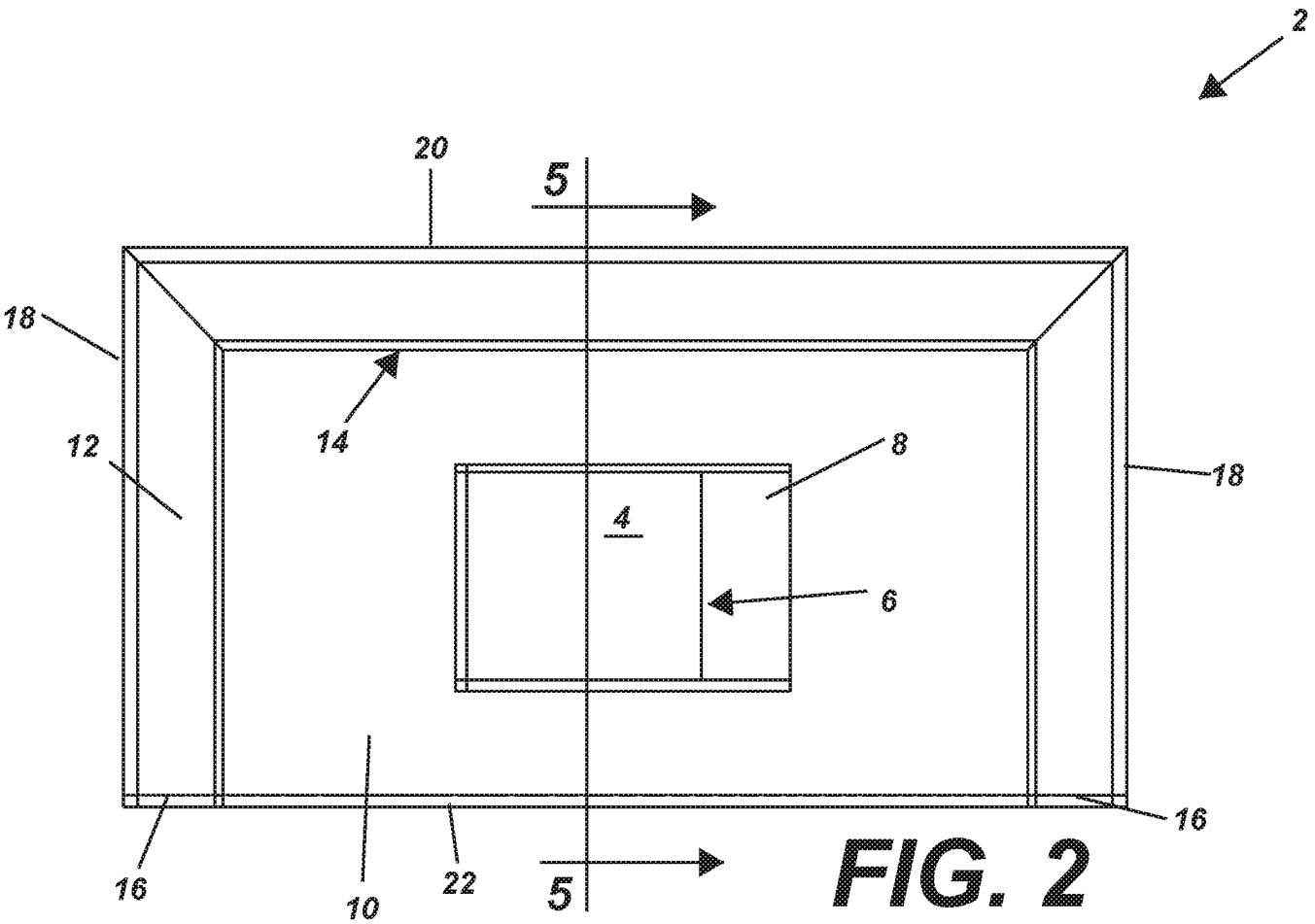
FIG. 2 is a top plan view thereof.
Figure 3:
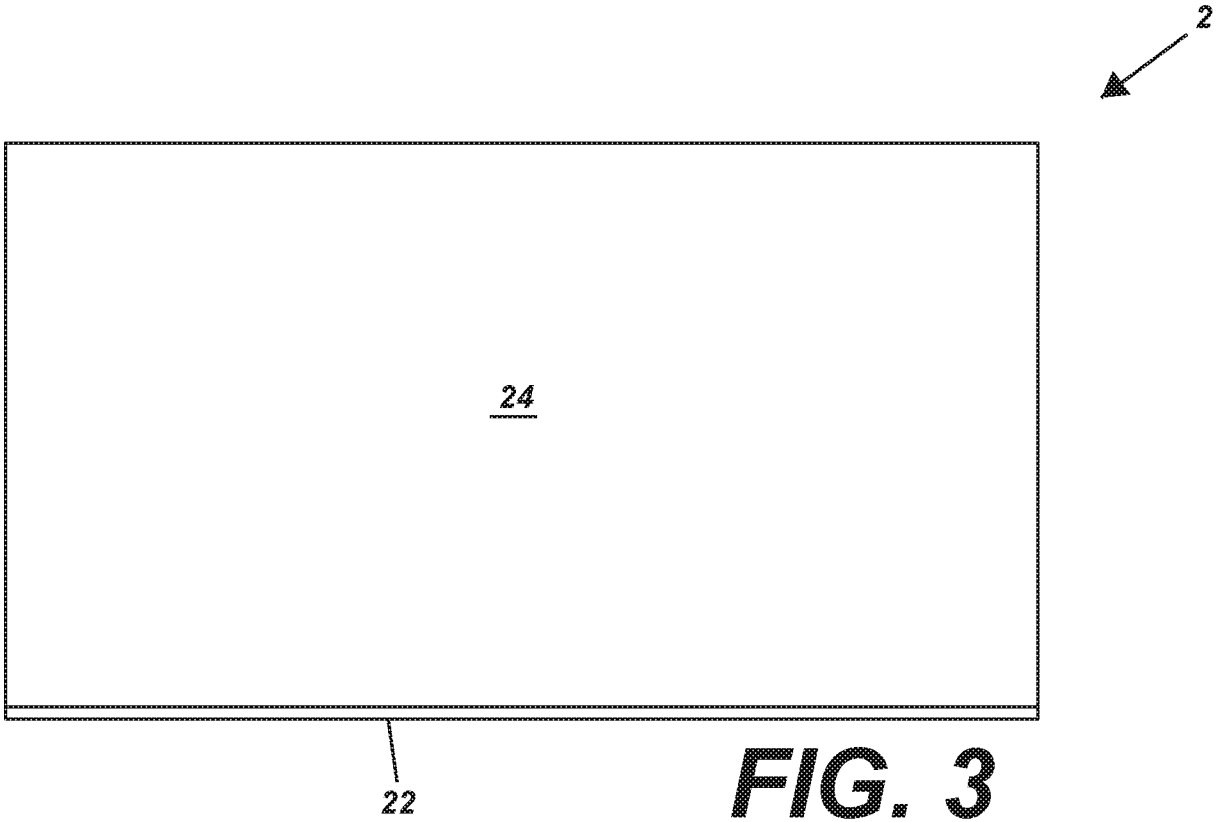
FIG. 3 is a rear plan view thereof.
Figure 4:
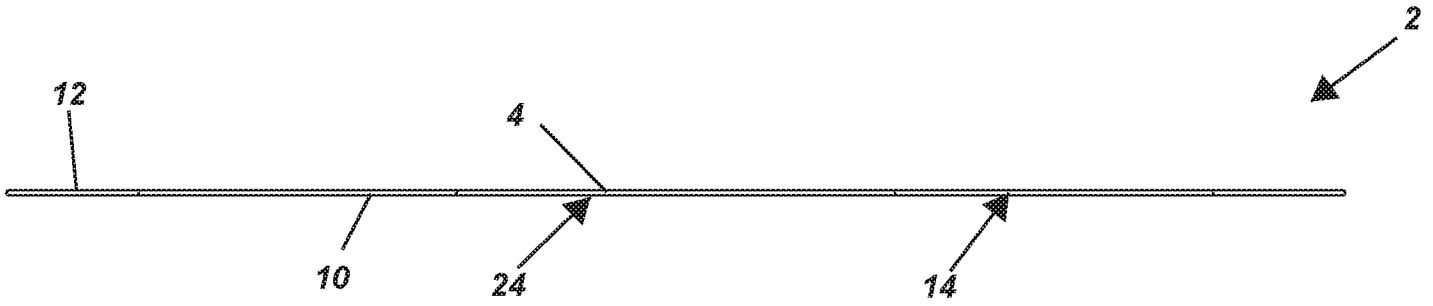
FIG. 4 is a front elevational view thereof.
Figure 5:
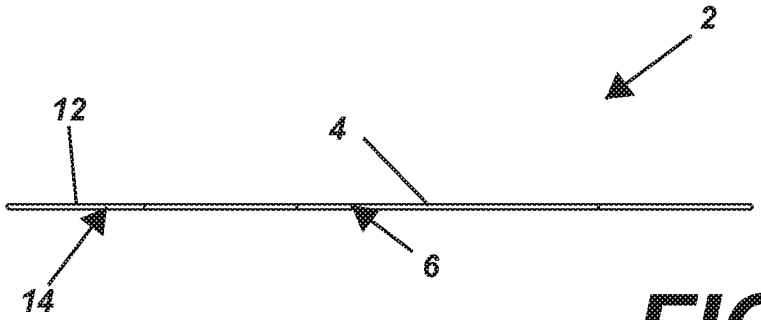
FIG. 5 is a side sectional view taken about the line of FIG. 2.

FIG. 3 shows the rear face 24 of the covering 10.

The ends of the flaps 12 can be sewn along a seam 16 to close those ends off, or they may be left open in an alternative embodiment.

An embodiment of the invention could leave the flaps 12 off of the covering 10, and the covering 10 edges could still be used to wrap about portions of the user's body while still using the pillow insert sleeve 4.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A pillow cover device comprising:

a covering comprising a top face, a rear face, a front edge, a rear edge, and a pair of side edges;

a sleeve with a pocket configured to receive a pillow;

a covering flap affixed to said pair of side edges and said rear edge of said covering, said covering flap affixed to an outer edge of said pair of side edges and rear edge and said covering flap opened towards a center of said covering and providing an opening only accessible from the top face of said covering, said opening configured for the reception of a user's limb;

said covering extending away from said sleeve by at least six inches; and said covering flap being at least four inches wide.

2. The pillow cover device of claim 1, further comprising a flap connected to said covering adjacent to said sleeve, said flap configured to cover an end of said pillow.

3. The pillow cover device of claim 1, further comprising a pair of seams closing said covering flap along said front edge in proximity to each respective one of said pair of side edges.

4. A method of encasing a pillow within a cover, the method comprising the steps:

inserting a pillow into pocket of a sleeve affixed to a covering, said covering extending away from said sleeve by at least six inches on either side of said sleeve, and said covering comprising a front edge, a rear edge, and a pair of side edges;

lifting a portion of a covering flap to receive a user's limb, said covering flap affixed to said pair of side edges and said rear edge of said covering and providing an opening only accessible from a top face of said covering; and wherein said covering flap is at least four inches in width.

5. The method of claim 4, further comprising the step of covering an edge of said pillow with a flap affixed to said covering adjacent to an opening of said pocket of said sleeve.

6. The method of claim 4, further comprising the step of closing said covering flap along said front edge in proximity to each respective one of said pair of side edges with a pair of seams.

* * * * *